US006626807B1

(12) United States Patent
Richmond

(10) Patent No.: US 6,626,807 B1
(45) Date of Patent: Sep. 30, 2003

(54) EXERCISE EQUIPMENT

(75) Inventor: David J. Richmond, Los Angeles, CA (US)

(73) Assignee: Total Tiger, Inc., Los Angeles, CA (US)

( * ) Notice: Subject to any disclaimer, the term of this patent is extended or adjusted under 35 U.S.C. 154(b) by 110 days.

(21) Appl. No.: 09/716,572

(22) Filed: Nov. 17, 2000

(51) Int. Cl.[7] ..... A63B 21/02

(52) U.S. Cl. ..... 482/123; 482/140; 482/907; 482/148

(58) Field of Search ..... 482/121–125, 482/130–135, 139, 148, 145, 49, 51, 140, 95, 46, 68, 62, 136–138, 128, 92, 126, 907

(56) References Cited

U.S. PATENT DOCUMENTS

| | | | | |
|---|---|---|---|---|
| 682,988 A | | 9/1901 | Hazelip | |
| 1,984,165 A | | 12/1934 | Tolchin | |
| 2,129,262 A | | 3/1938 | Cole | |
| 2,783,045 A | | 2/1957 | Bosch | |
| 3,120,954 A | | 2/1964 | Apostol | |
| 3,572,701 A | | 3/1971 | Agamian | |
| 3,584,871 A | * | 6/1971 | Kehmon | 272/82 |
| 3,589,720 A | | 6/1971 | Agamian | |

(List continued on next page.)

FOREIGN PATENT DOCUMENTS

| | | |
|---|---|---|
| DE | 634093 | 12/1937 |
| DE | 2017216 | 4/1970 |
| DE | 2029451 | 6/1970 |
| DE | 3533481 A1 | 9/1985 |
| FR | 2356437 | 6/1976 |
| GB | 2160433 A | 12/1985 |

OTHER PUBLICATIONS

AsSeenOnTV.com, Total Tiger, pp. 1–3.*

*Primary Examiner*—Nicholas D. Lucchesi
*Assistant Examiner*—Lori Baker Amerson
(74) *Attorney, Agent, or Firm*—Fulwider Patton et al; Ellsworth R. Roston

(57) ABSTRACT

In one preferred embodiment, first and second platforms are respectively provided for supporting a user's arms and knees. Rollers on the bottom surface of at least one of the units facilitate relative movements between the units. A detent may extend from the unit receiving the user's legs to retain the user's calves or ankles on the unit. An elastic cord separable from at least one of the units may extend between the units to provide for a controlled relative movement between the units and to facilitate a collapse of the unit into suitcase size. In another preferred embodiment, a pair of units having straps for grasping by the units hands are provided, one for each of the user's arms. Each unit is rotatable and/or movable linearly on a support surface in any direction independently of the other. A third unit is for receiving and retaining the user's feet may be disposed on a rod which is adjustable in length in accordance with the length of the user's feet between the kneecaps and the ankles. A detainer vertically adjustable in height near one end of the rod receives and positions the user's ankles. Elastic cords may extend between the third unit and each of the first and second units. In a third embodiment, the cords have handles replacing the first and second units at the ends displaced from the third unit. In all embodiments, the units may be made from, or covered with, a pliant material.

82 Claims, 8 Drawing Sheets

U.S. PATENT DOCUMENTS

| | | | | | |
|---|---|---|---|---|---|
| 3,658,327 | A | | 4/1972 | Thiede | |
| 3,707,284 | A | * | 12/1972 | Waldeck | 272/58 |
| 3,752,475 | A | | 8/1973 | Ott | |
| 4,101,124 | A | | 7/1978 | Mahnke | |
| 4,126,308 | A | * | 11/1978 | Crumley | 272/64 |
| 4,136,867 | A | | 1/1979 | Wilkin | |
| 4,207,879 | A | | 6/1980 | Safadago et al. | |
| 4,584,512 | A | | 4/1986 | Pritchard | 318/696 |
| 4,629,179 | A | | 12/1986 | Bilzilia | |
| 4,648,026 | A | | 3/1987 | Petrick | 318/696 |
| 4,658,194 | A | | 4/1987 | Richter et al. | 318/696 |
| 4,678,444 | A | | 7/1987 | Monreal | |
| 4,683,408 | A | | 7/1987 | Inoue et al. | 318/696 |
| 4,691,919 | A | | 9/1987 | Roberson | |
| 4,706,953 | A | | 11/1987 | Graham | |
| 4,714,867 | A | | 12/1987 | Palmin et al. | 318/696 |
| 4,720,099 | A | | 1/1988 | Carlson | |
| 4,749,931 | A | | 6/1988 | Kegel et al. | 318/696 |
| 4,788,484 | A | | 11/1988 | Bolash et al. | 318/696 |
| 4,830,363 | A | | 5/1989 | Kennedy | |
| 4,830,367 | A | | 5/1989 | Foran | |
| 4,848,740 | A | | 7/1989 | VanDerHoeven | |
| 4,855,660 | A | | 8/1989 | Wright et al. | 318/696 |
| 4,867,142 | A | | 9/1989 | Jones | |
| 4,911,438 | A | | 3/1990 | Van Straaten | |
| 5,066,003 | A | | 11/1991 | Jones | |
| 5,070,863 | A | | 12/1991 | McArthur et al. | |
| 5,100,131 | A | | 3/1992 | Fong | |
| 5,106,083 | A | | 4/1992 | Hall | |
| 5,125,884 | A | | 6/1992 | Weber et al. | |
| 5,147,259 | A | | 9/1992 | Hutchins | |
| 5,163,890 | A | | 11/1992 | Perry, Jr. | |
| 5,176,603 | A | | 1/1993 | Hundley | |
| 5,190,513 | A | | 3/1993 | Habing et al. | |
| 5,205,804 | A | | 4/1993 | Hall | |
| 5,224,909 | A | | 7/1993 | Hamilton | |
| 5,261,866 | A | | 11/1993 | Mattox | |
| 5,340,108 | A | | 8/1994 | Gerpheide et al. | 273/185 |
| 5,354,251 | A | | 10/1994 | Sleamaker | |
| 5,364,327 | A | | 11/1994 | Graham | |
| 5,449,961 | A | | 9/1995 | Ludwig et al. | |
| 5,460,587 | A | | 10/1995 | Hutchins | |
| 5,472,401 | A | | 12/1995 | Rouillard et al. | |
| 5,499,961 | A | | 3/1996 | Mattox | 482/132 |
| 5,518,483 | A | | 5/1996 | Oswald | 482/131 |
| 5,527,248 | A | | 6/1996 | Crivello | |
| 5,921,901 | A | | 7/1999 | Palacios | 482/132 |
| 6,120,423 | A | * | 9/2000 | Mackey et al. | 482/121 |
| 6,196,955 | B1 | * | 3/2001 | Chuang | 482/132 |
| 6,203,476 | B1 | * | 3/2001 | Wang et al. | 482/121 |

* cited by examiner

FIG. 1A
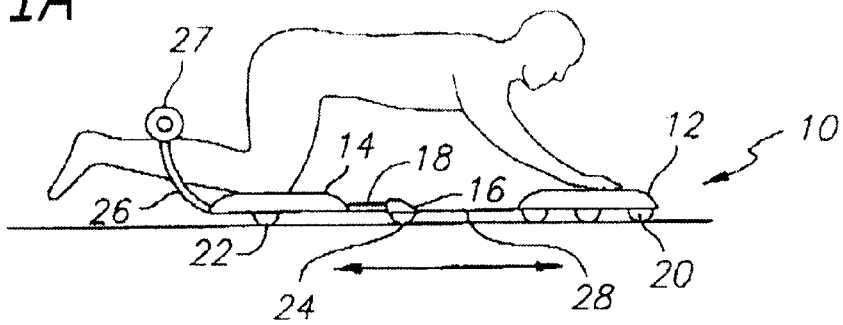
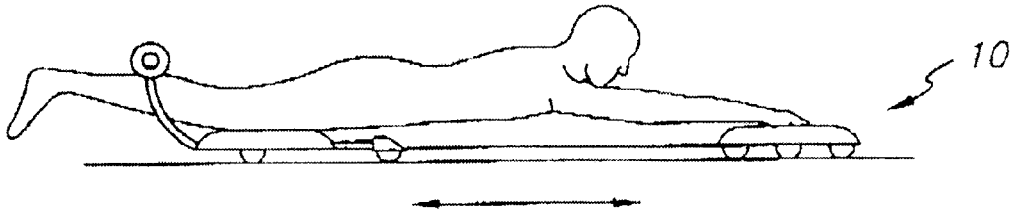
FIG. 1B
FIG. 2A
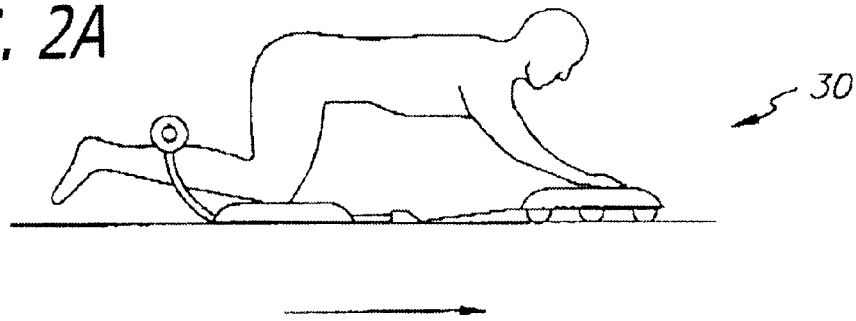
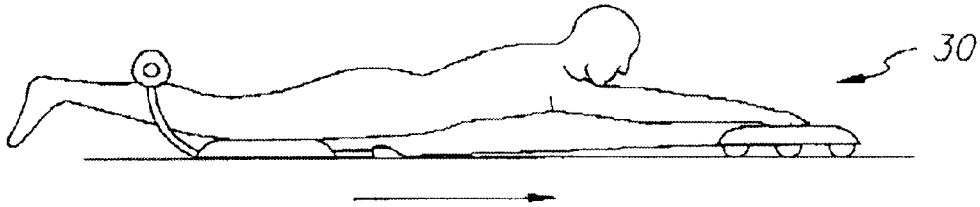
FIG. 2B

FIG. 3A
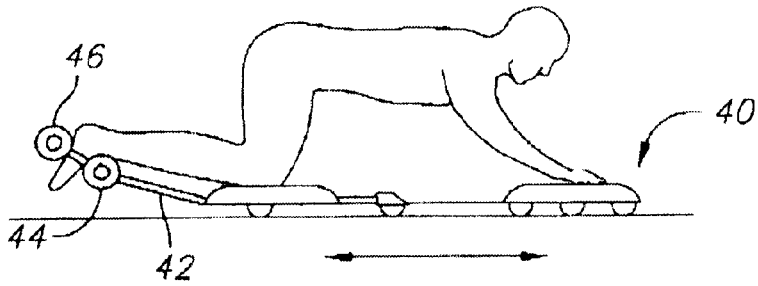
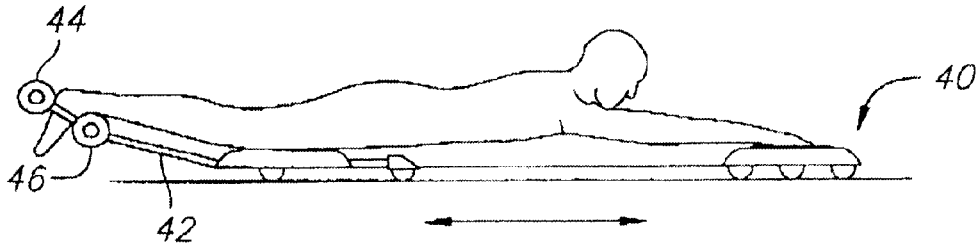
FIG. 3B
FIG. 4A
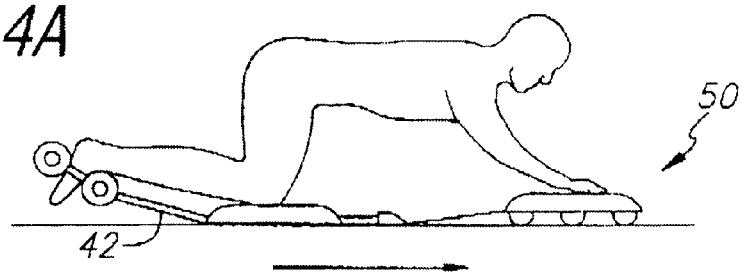
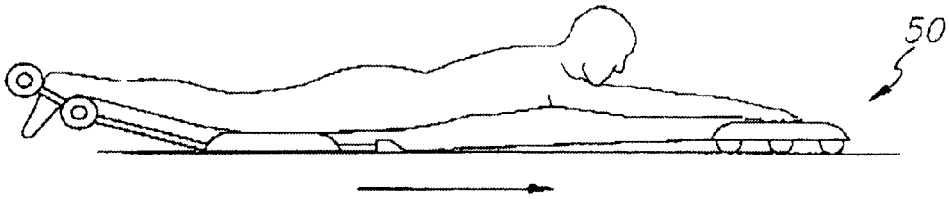
FIG. 4B

EXERCISE EQUIPMENT

This invention relates to exercise equipment. More particularly, this invention relates to exercise equipment which is simple in construction, easily portable by the user, reliable and efficient in operation, inexpensive and light in weight in providing exercise to a user.

BACKGROUND OF A PREFERRED EMBODIMENT OF THE INVENTION

The public is becoming increasingly conscious of the importance of being healthy. Individuals are becoming aware that an important aspect of remaining healthy is to exercise regularly. They appreciate that exercise involves the repetitive use of various muscles and the subjection of the heart to some stress.

In general, exercise equipment is becoming increasingly complex, cumbersome, expensive and complicated to use. This is contrary to the interests of the users who are interested in obtaining exercise equipment which is inexpensive, simple in construction, easy to use and efficient and reliable in providing exercise to the user. Users are particularly interested in obtaining exercise equipment which meets all of the criterial specified in the previous sentence and which additionally is light in weight, easily assembled and disassembled and small in occupied space.

In this way, users can easily carry the exercise equipment in a disassembled form when they travel and the users can easily and quickly assemble and operate the exercise equipment when they reach their destination. This is becoming increasingly important because business and social engagements require increasingly frequent travels for a large number of people.

New exercise equipments of all kinds are being constantly introduced to the public. None meets the criteria specified in the previous paragraph. If anything, they are becoming increasingly opposite in their performance characteristics from the characteristics specified above. This is true even though exercise equipment is known to, and even used by, a large percentage of the population. Those people are interested in obtaining exercise equipment meeting the specified criteria specified above and who are devoting their creative talents in conceiving, and attempting to conceive, exercise equipment to meet such criteria.

BRIEF DESCRIPTION OF PREFERRED EMBODIMENTS OF THE INVENTION

In one preferred embodiment, first and second platforms are respectively provided for supporting a user's arms and knees. Rollers on the bottom surface of at least one of the units facilitate relative movements between the units. A detent may extend from the unit receiving the user's legs to retain the user's calves or ankles on the unit. An elastic cord separable from at least one of the units may extend between the units to provide for a controlled movement between the units relative to each other and to facilitate a collapse of the unit into a suitcase size.

In another preferred embodiment, a pair of units having straps for grasping by the unit's handle are provided, one for each of the user's arms. Each unit is rotatable and/or movable linearly on a support surface in any direction independently of the other. A third unit is for receiving and retaining the user's feet. It may be disposed on a rod which is adjustable in length in accordance with the length of the user's feet between the kneecap and the ankle. A detainer vertically adjustable in height near one end of the rod receives and positions the user's ankles. Elastic cords may extend between the third unit and each of the first and second units In a third embodiment, the cords have handles replacing the first and second units at the ends displaced from the third unit. In all embodiments, the units may be made from, or covered with, a pliant material.

BRIEF DESCRIPTION OF THE DRAWINGS

FIG. 1A is a schematic elevational view of exercise equipment constituting a first preferred embodiment of the invention and shows the user in a crouching position;

FIG. 1B is a schematic elevational view of the exercise equipment shown in FIG. 1A and shows the user in a prone position;

FIG. 2A is a schematic elevational view of exercise equipment constituting a second preferred embodiment of the invention and shows the user in a crouching position;

FIG. 2B is a schematic elevational view of the exercise equipment shown in FIG. 2A and shows the user in a prone position;

FIG. 3A is a schematic elevational view of exercise equipment constituting a third preferred embodiment of the invention and shows the user in a crouching position;

FIG. 3B is a schematic elevational of the exercise equipment shown in FIG. 3A and shows the user in a prone position;

FIG. 4A is a schematic elevational view of exercise equipment constituting a fourth preferred embodiment of the invention and shows the user in a crouching position;

FIG. 4B is a schematic elevational view of the exercise equipment shown in FIG. 4A and shows the user in a prone position;

DETAILED DESCRIPTION OF PREFERRED EMBODIMENTS OF THE INVENTION

Figure 5:
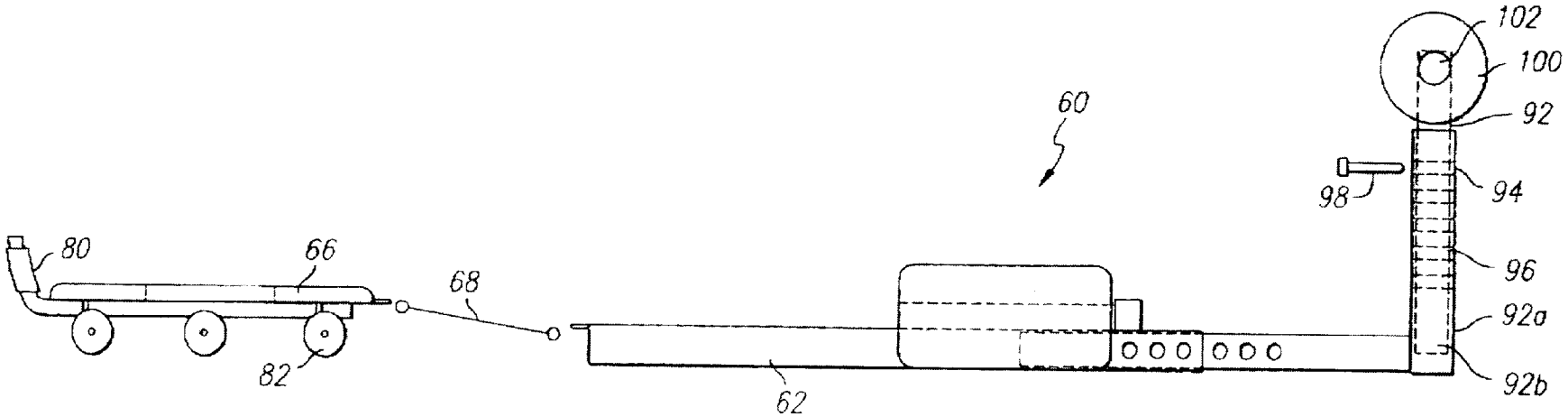
FIG. 5 is a schematic front elevational view of exercise equipment constituting a fifth preferred embodiment of the invention.

FIGS. 1A and B show preferred embodiment, generally indicated at 10, of exercise equipment included in this invention. The exercise equipment 10 includes a pair of members, units or platforms 12 and 14. Each of the platforms 12 and 14 preferably has upper and lower surfaces preferably substantially parallel to each other.

The upper surface of the platform 12 receives and supports a user's hands or arms. The upper surface of the platform 14 receives and supports a user's knees. The platforms 12 and 14 may be made from a pliant material (e.g. foam) to provide comfort to the user when the user rests the user's weight on the platforms by disposing the user's arms or hands on the platform 12 and the user's knees on the platform 14. Alternatively, the platforms 12 and 14 may be made from a material (e.g. wood or aluminum) which is strong and light in weight and the top of the platform may be covered with a pliant material such as a foam, cloth or leather. A stabilizing extension 16 may be attached to the forward end of the platform 14 as by a strap 18.

Elements such as rollers 20 and 22 are respectively attached to the bottom surfaces of the platforms 12 and 14 and a roller 24 may be attached to the bottom surface of the extension 16. The rollers 20, 22 and 24 respectively provide for linear movements of the platforms 12 and 14. A detent 26 extends in a loop from the platform 14 to receive and fixedly retain the user's legs at the calves of the user. The detent may include a roller 27 which is movable on the user's calf when the user moves from a crouching position as shown in FIG. 1A to a prone position as shown in FIG. 1B.

An elastic cord 28 may be removably attached at its opposite ends to the rear end of the platform 12 and the forward end of the extension 18. The cord 28 functions to assist the user in moving in one direction and in resisting movement in an opposite direction. The cord 28 may be adjustable in length or density to offer different levels of resistance to the movement of the platform 12 in opposite directions and the movement of the platform 14 and the extension 18 in the opposite directions. It will be appreciated that, although inclusion of the elastic cord may be preferred, the platforms 12 and 14 will function without the elastic to provide exercise to the user.

When the user desires to exercise by using the exercise equipment 10, the user adopts a crouching position as shown in FIG. 1A with the user's hands on the platform 12 and the user's knees on the platform 14 and with the user's feet fixedly retained by the detent 24. The user then slides the platform 12 forwardly or the platform 14 and the extension 18 rearwardly or simultaneously slides the platform 12 forwardly and the platform 14 rearwardly. When this occurs, the user is in a substantially prone position as indicated schematically in FIG. 1B.

The user can reverse the direction(s) of movement of the platform 12 and the platform 14 to assume the position shown schematically in FIG. 1B. Repetitive movements of the user between the positions shown in FIGS. 1A and 1B can provide meaningful exercising and toning of many muscles in the user's body. This is particularly true since the user controls the rate at which the platforms 12 and 14 and the extension 18 move and the distance through which they move.

The exercise equipment 10 has certain important advantages. It provides for a meaningful exercise of the movement in the user's body without requiring the user to pull on or against any stationary or bulky objects. It provides an opportunity for all levels of users to exercise all of the major groups of muscles in the upper and lower body simultaneously. Furthermore, it has a minimal number of components, all of light weight and minimal size. The components can also be easily assembled or disassembled. exercise equipment 40 has the same advantages as those specified above for the exercise equipment 10.

FIGS. 4A and 4B schematically illustrate a fourth preferred embodiment, generally indicated at 50 of the invention. The exercise equipment 50 is substantially identical to the exercise equipment 30 except that it includes the detent 42 in FIGS. 5 and 6. The exercise equipment 50 has the same advantages as those specified above for the exercise equipment 10. The embodiment shown in FIGS. 4A and 4B is further advantageous in that it provides for an easy insertion of the user's ankles into the detent 42 and an easy removal of the user's ankles from the detents.

FIGS. 5–8 show another preferred embodiment, generally indicated at 60, of the invention. The exercise unit includes a rod or spinal member 62 made from a suitable material such as steel and preferably having a tubular construction. The rod 62 preferably extends in a linear direction. A pair of platforms 64 and 66 may be respectively coupled to the rod 62 by elastic cords 68 and 70 each of which may be removably attached to an individual one of the platforms 64 and 66 at one end and to the rod 62 at the other end. It will be appreciated that, although inclusion of the elastic cords 68 and 70 may be preferred, the embodiment 60 will function to provide exercise to the user without including the elastic cords.

The exercise equipment 10, whether in assembled or disassembled form, can be easily carried by the user when the user is traveling. In this way, the user can continue with the same exercise routine(s) whether the user is at home or is traveling on business or for pleasure. Furthermore, by retaining the user's feet at the calves rather than at the ankles, stress is removed from the joints between the user's legs and the ankles and is localized at the calves which are relatively stable even when force is applied to move the platforms.

FIGS. 2A and 2B schematically illustrate a second preferred embodiment, generally indicated at 30, of the invention. The embodiment 30 is the same as the embodiment 10 except that it does not include the roller(s) 22 on the platform 14 or the roller(s) 24 on the extension 18. It will be appreciated that the rollers 20 can be removed from the platform 12 instead of removing the rollers 22 from the platform 14 and the extension 18. The exercise equipment 30 has the same advantages as those specified above for the exercise equipment 10.

Figure 6:
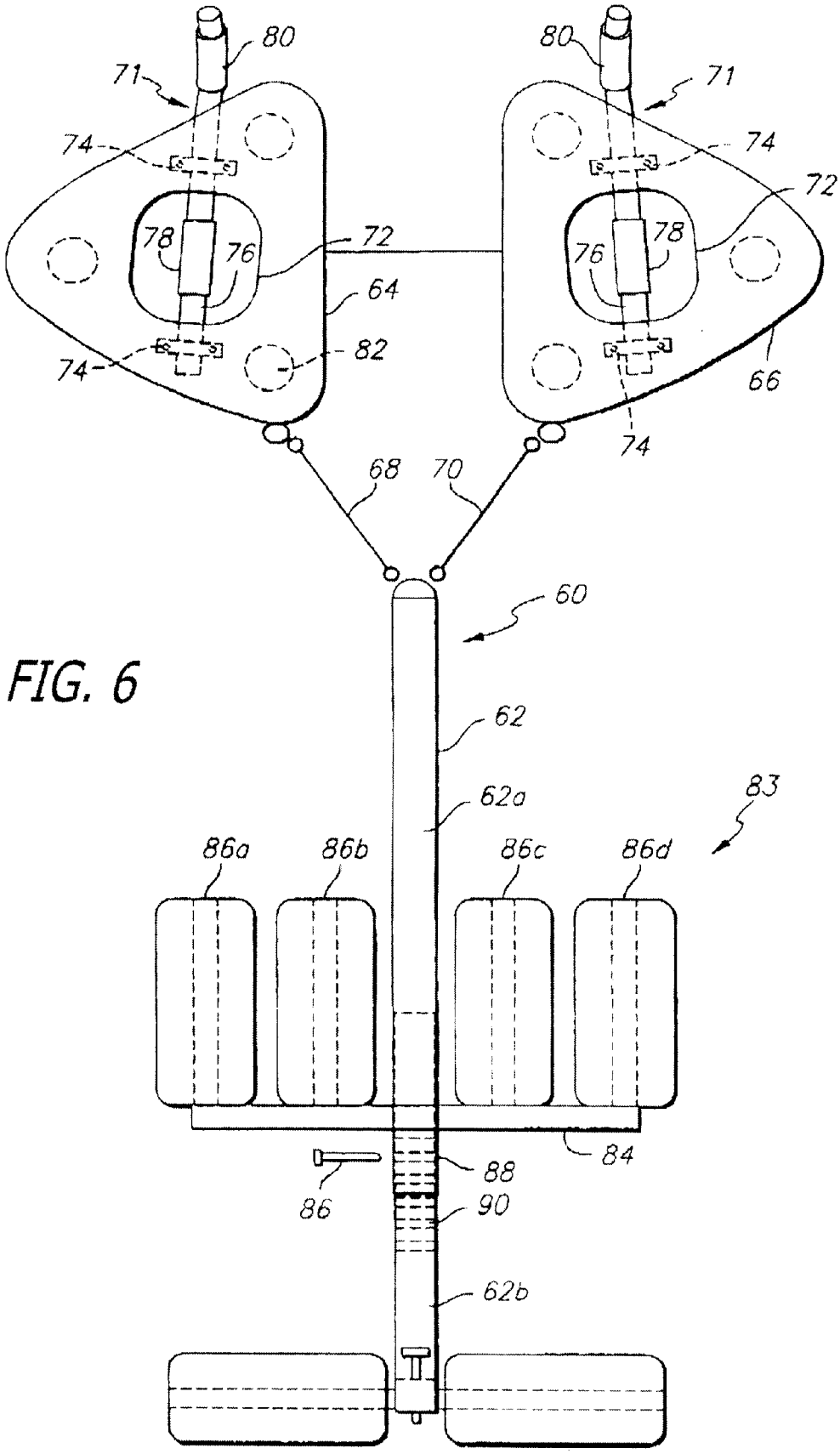
FIG. 6 is a schematic top plan view of the exercise equipment shown in FIG. 5.
Figure 7:
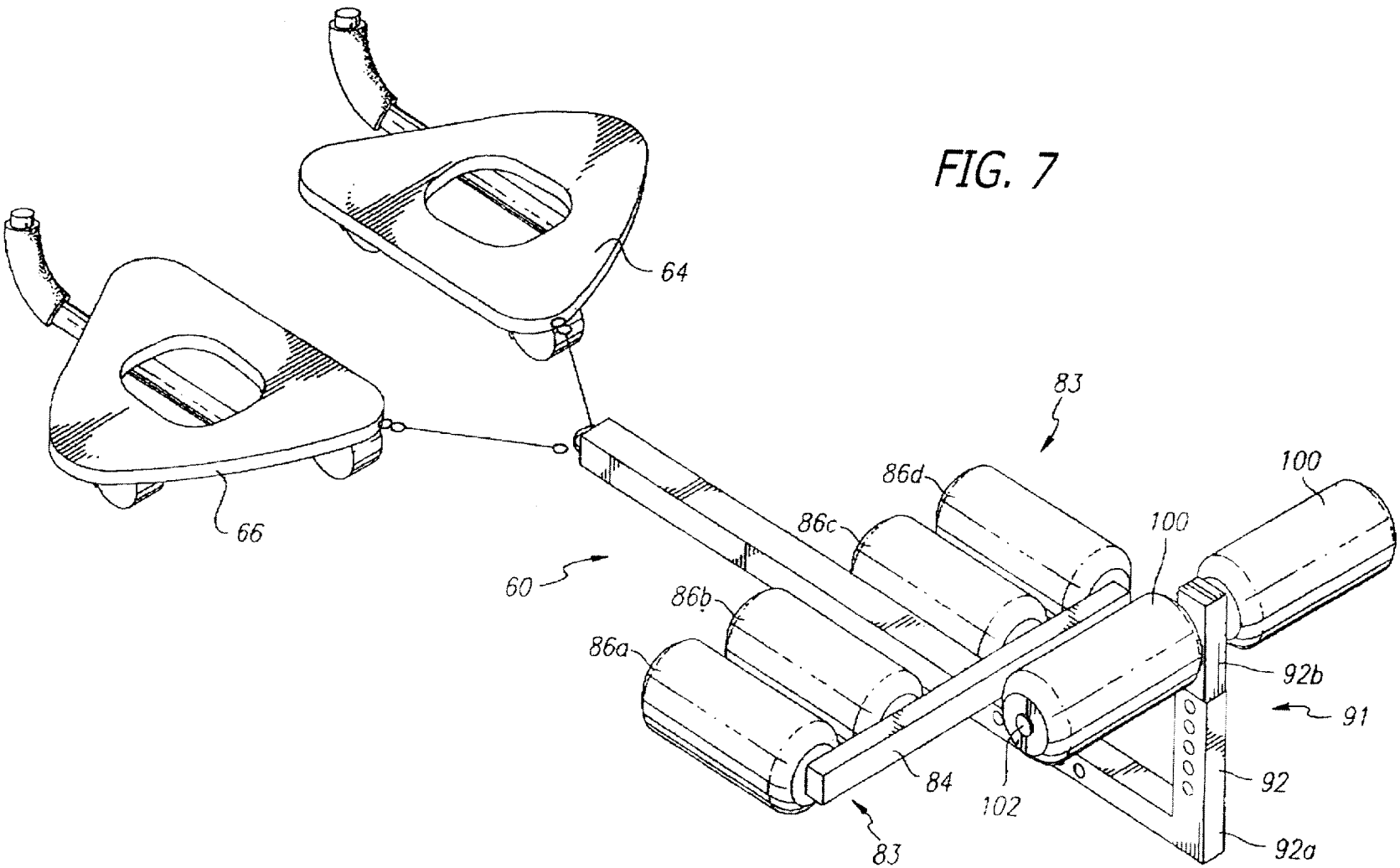
FIG. 7 is a schematic perspective view of the exercise equipment shown in FIGS. 5 and 6, as seen from a position above and in front of the exercise equipment.

FIGS. 3A and 3B schematically illustrate a third preferred embodiment, generally indicated at 40 of the invention. The exercise equipment 40 is substantially identical to the exercise equipment 10 except that it includes a detent 42 which retains the user's ankles in fixed position when the user is exercising. The detent 42 may include a pair of rollers 44 and 46 which are disposed relative to each other to retain the sole of the user's foot between the rollers. The The cords 68 and 70 may be adjustable in length and/or density to offer different levels of resistance to the efforts of the user to propel the user's body along a support surface, as will be explained in detail subsequently. The cords 68 and 70 are shown in FIG. 6 as being respectively attached to the platforms 64 and 66 and as being separated from the rod 62.

Each of the platforms 64 and 66 may have centrally disposed holes 72. Handle structures generally indicated at 71 are disposed on the platforms 64 and 66. The handle structures 71 include retainers 74 disposed on the top surface of the platform at the opposite ends of the holes 72 to receive a gripper 76 made from a suitable material such as steel. The gripper 76 may be tilted upwardly at the end removed from the cords 68 and 70.

A handle 78 made from a suitably pliant material is disposed on the portion of the gripper 76 disposed above the hole 72. A handle 80 also made from a pliant material is disposed on the gripper 76 at the end of the gripper removed from the cords 68 and 70. Rollers 82 are disposed on the bottom surface of the platforms 64 and 66. The rollers 82 are constructed and shaped (e.g. spherical) and attached to the respectively ones of the platforms 64 and 66 to roll in any direction on a support surface.

A support generally indicated at 83 includes a crossbar 84. The crossbar 84 is attached to the rod 62 at an intermediate position along the length of the crossbar. A plurality of support members 86*a,* 86*b,* 86*c* and 86*d* are suitably attached to the crossbar 84 at spaced positions on the crossbar. The support members 84*a* and 84*b* are preferably disposed on one side of the rod 62 and the support members 84*c* and 84*d* are preferably disposed on the opposite side of the rod. The spacing between the support members 84*a* and 84*b* and between the support members 84*c* and 84*d* may be a suitable distance such as approximately one-half (½) of an inch.

The support members 84*a*–84*d* are preferably made from a pliant material, or are covered with a pliant material (e.g. a foam material), to receive the user's knees and to provide comfort to the user with the user's knees disposed in a particular relationship to the support member. One of the user's knees is disposed in the space between the support members 84*a* and 84*b* but in contact with the support members. A similar relationship is provided between the other knee of the user and the support members 84*c* and 84*d*. This relationship provides comfort to the user because the user's knees do not directly contact the support members such as the support members 84*a* and 84*b*.

The rod 62 may be formed from two (2) pieces 62*a* and 62*b* one of which is disposed in telescoping relationship to the other to provide the rod with an adjustable length. The adjustable telescoping relationship may be provided by passing a pin 86 through a hole 88 in the rod piece 62*a* and any desired one of a plurality of holes 90 in the rod piece 62*b*. The rod 62 is adjustable in length in accordance with the relative length of the user's legs between the user's kneecaps and ankles.

A fourth support member generally indicated at 91 includes an upright 92. The upright 92 may be attached to the rod 62 at the end of the rod. The upright 92 is disposed in a transverse (preferably perpendicular) relationship relative to the rod 62. The upright 92 may be formed from two (2) telescoping pieces 92*a* and 92*b*. The piece 92*a* may be provided with a hole 94, and the piece 92*b* may be provided with holes 96, to receive a pin 98. In this way, the height of pads 100 above the support surface can be adjusted in accordance with the length of the user's foot between the knee and ankle. The pads 100 are disposed on the opposite sides of the upright 92. The pads 100 are supported by a crossbar 102 preferably extending in a horizontal direction from the upright 92.

When the user wishes to operate the exercise unit 60, the user disposes the user's arms on the platforms 66 and 66. If the user is a neophyte in the operation of the exercise equipment 60, the user may place the user's arms on the platforms 66 and 66 and grasp the handles 80. This allows the user's arms to extend across the full lengths of the platforms. When the user has become accustomed to operating the exercise equipment 60 or when the user's muscles have become firmed, only a portion of the user's arms may be disposed on the platform and the handles 78 may be grasped by the user's hands.

The user disposes one of the user's knees between the support members 84*a* and 84*b* and the other knee between the support members 84*c* and 84*d*. This causes one of the user's kneecaps to be cradled between the support members 84*a* and 84*b* so that it does not meet any resistance of a flat surface. This causes the user's knee to be more comfortable than it would be on a flat surface. Of course, the same enhanced comfort is provided for the other knee cap by the support members 84*c* and 84*d*. It will be appreciated that the support members 84*a* and 84*b* may be replaced by a platform corresponding to the platform 14 in FIGS. 1A and 1B and that the support members 84*c* and 84*d* may be replaced by another platform corresponding to the platform 14 in FIGS. 1A and IB.

As previously indicated, the length of the rod 62 is adjustable in accordance with the length of the user's foot between the knee cap and the ankle. The user's ankles are disposed on the pads 100 when the user's kneecaps are disposed between the support members 84*a* and 84*b* and between the support members 84*c* and 84*d*.

When the user's body is properly disposed on the exercise equipment 100, the user can begin to exercise. The user can operate each of the platforms 62 and 64 on a coordinated basis or independently of each other. For example, the user can move the platforms 62 and 64 forward and backward on a coordinated basis as in a butterfly stroke in swimming. Alternatively, the user can move one platform forwardly and simultaneously move the other platform backwardly as in a normal swimming stroke. As another example, the user can provide FIG. 8 motions for each of the platforms 62 and 64 coordinated with, or independently of, the FIG. 8 motion of the other platform.

As will be seen, the equipment 60 is able to exercise all of the user's muscles which are exercised by the equipments 30, 40, 50 and 54. The exercise equipment 60 is also able to exercise other muscles in addition to those exercised by the units 30, 40, 50 and 54 because it provides different movements for the platforms 62 and 64 than the movements provided by the units 30, 40, 50 and 54.

Figure 8:
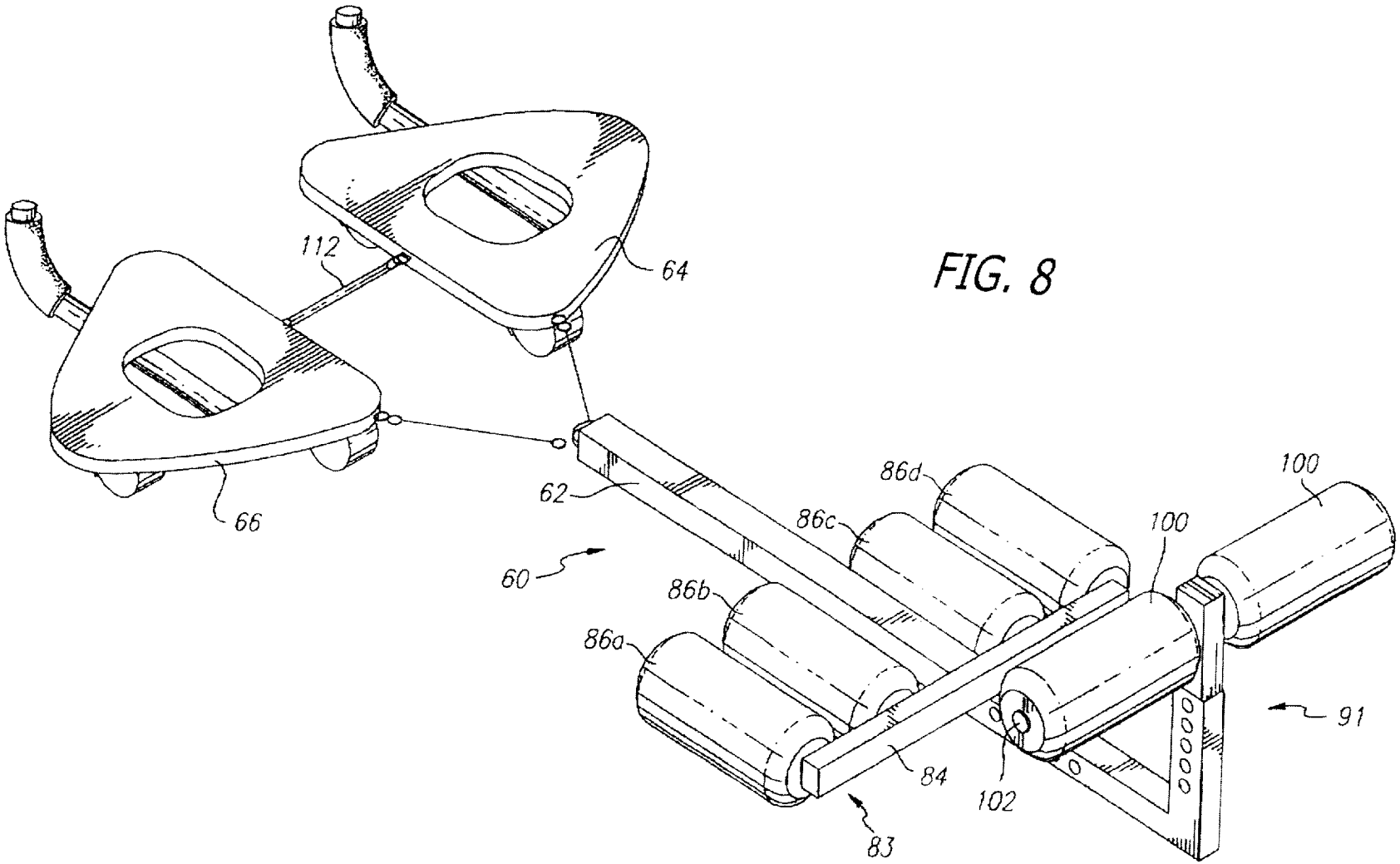
FIG. 8 is a schematic fragmentary plan view of a modification in the preferred embodiment shown in FIGS. 5–7.

FIG. 8 shows another preferred embodiment, generally indicated at 110, of the invention. The preferred embodiment 110 is similar in most respects to the exercise equipment 60. However, the exercise equipment 110 includes a strap 112 removably attached at opposite ends to the platforms 62 and 64. This prevents the platforms 60 and 62 from moving independently relative to each other. When the platforms 60 and 62 are coupled to each other by the strap 112, the user can independently exercise the user's lower body by extending the user's knees away from the user's torso and then curling back up to the user's torso.

Figure 9:
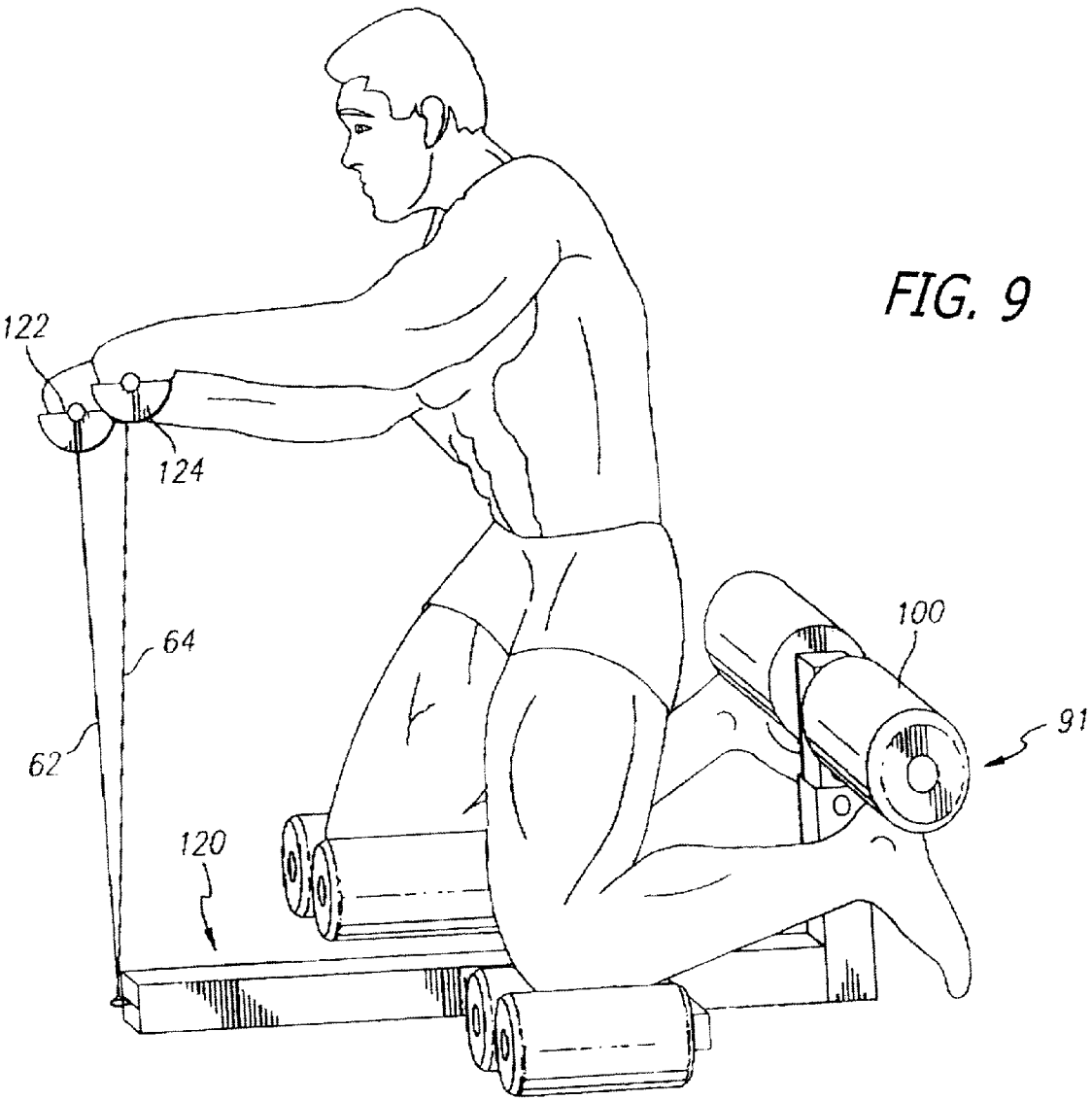
FIG. 9 is a schematic perspective view of exercise equipment constituting a sixth preferred embodiment of the invention.

FIG. 9 schematically shows another preferred embodiment, generally indicated at 120, of an exercise equipment constituting the invention. The exercise equipment 120 is similar in construction to the exercise equipment 110 except that it does not include the platforms 64 and 66. Instead, the ends of the elastic cords 68 and 70 displaced from the rod 62 are respectively and removably attached to handles 122 and 124.

Figure 10:
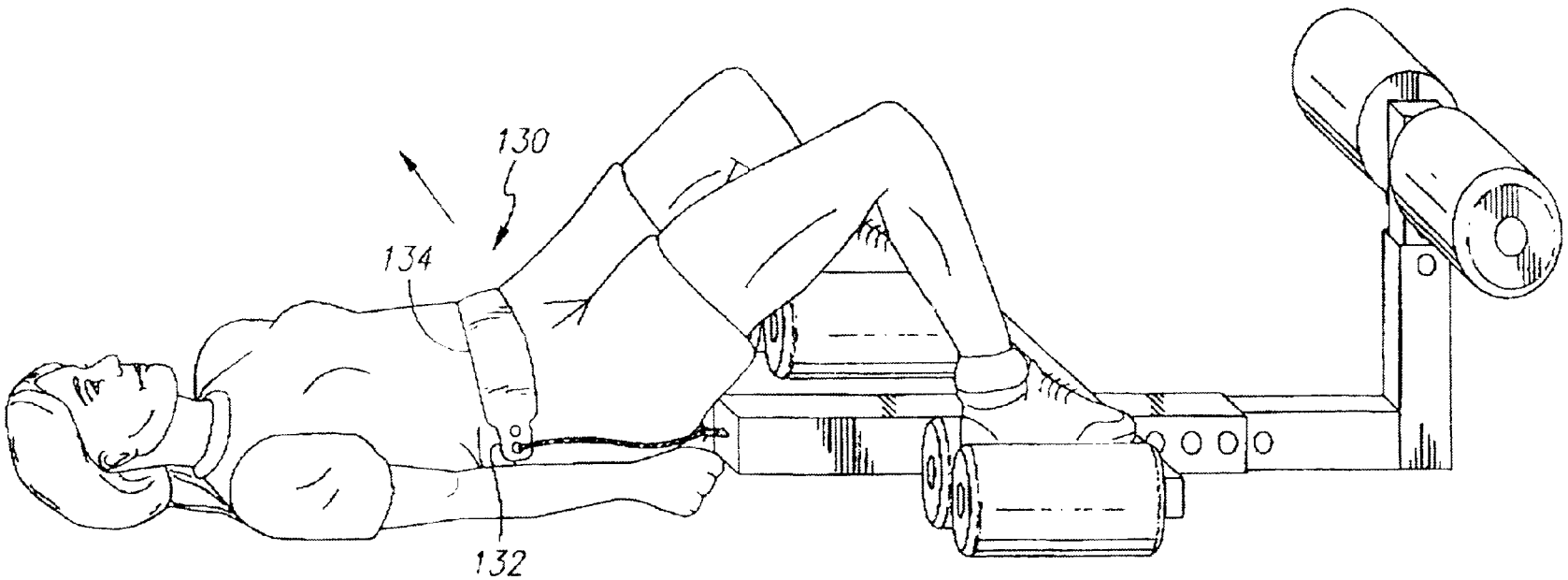
FIG. 10 is a schematic perspective view of exercise equipment constituting a seventh preferred embodiment of the invention.

When the handles 122 and 124 are attached to the free ends of the elastic cords 68 and 70, the user is able to perform additional exercises, particularly for the user's upper body. The user sits upright on the user's knees as shown schematically in FIG. 9. Alternatively, the user can sit on the pads 100 included in the support 91. In these alternative portions, the user can perform exercises such as curls, tricep curls, shoulder shrugs and a number of other well-known exercises FIG. 10 is a perspective view of another preferred embodiment, generally indicated at 130, of an exercise equipment constituting the invention. In the embodiment 130, an elastic cord 132 is removably attached at its opposite ends to opposite sides of the rod 62. The cord 132 may be reinforced at its middle portion as indicated at 134. When the elastic cord is attached at its opposite ends to the rod 62, the user may lie on the user's back and the user may extend through the user's legs the loop defined by the cords, that the cord abuts the user's pelvis. The user may independently exercise the user's legs. Alternatively, the user may lift the user's body to a sitting position from a reclining position. The user may bend the user's knees so that the user's feet are disposed on the support members 84*a*–84*d*. Alternatively, the user may extend the user's legs so that the ends of the user's legs are retained by the support 91.

Although this invention has been disclosed and illustrated with reference to particular preferred embodiments, the principles involved are susceptible for use in numerous other embodiments which will be apparent to persons of ordinary skill in the art. The invention is, therefore, to be limited only as indicated by the scope of the appended claims.

What is claimed is:

1. In combination in exercise equipment for a user, a first unit for supporting the user's knees, a second unit for supporting the user's arms, the units being constructed to provide for a movement of the units relative to each other, an elastic cord connected between the units to provide for a relative movement between the units in accordance with forces imposed on the units by the user, and a third unit for retaining the user's feet at positions below the user's knees.

2. In a combination as set forth in claim 1 wherein each of the first and second units has upper and lower surfaces and wherein the first and second units have at their lower surfaces elements for providing for a movement of each of the units relative to the other in accordance with the forces imposed upon the units by the user.

3. In a combination as set forth in claim 1 wherein at least the second unit is provided at its lower surface with elements to provide for a movement of the second unit relative to the first element.

4. In a combination as set forth in claim 1 wherein the elastic cord is removably connected between the back of the second unit and the front of the first unit.

5. In a combination as set forth in claim 4 wherein rollers are disposed on the bottom surface of the second unit to provide for a movement of the second unit relative to the first unit.

6. In a combination as set forth in claim 5 wherein the first unit is positionable on a support surface without any rollers on the bottom surface of the first unit.

7. In a combination as set forth in claim 5 wherein rollers are provided on the bottom surface of the first unit to facilitate a movement of the first unit relative to the second unit on the support surface.

8. In a combination as set forth in claim 5 wherein the third unit includes a detent extending from the first unit for fixedly retaining the user's feet during the movement of the first and second units relative to each other.

9. In a combination as set forth in claim 8 wherein the detent fixedly retains the user's ankles during the movement of the first and second units relative to each other.

10. In a combination as set forth in claim 8 wherein the detent fixedly retains the user's calves during the movement of the first and second units relatively to each other.

11. In combination in exercise apparatus for a user, including, a first platform for supporting the arms of the user, platforms a second platform for supporting the knees of the user, the first and second platforms being separated from each other and the platforms being movable relative to each other, an elastic member made from a material alternately having constraining and non-constraining relationships in accordance with the exercise of the user and extending between the platforms for maintaining the platforms in a coupled relationship with a variable spacing between the platforms in accordance with variations in the movement between the members and the constraining and non-constraining relationships of the elastic member, and a member operatively coupled to the second platform for retaining the feet of the user at a position below the knees of the user during the movements of the first and second platforms relative to each other.

12. In a combination as set forth in claim 11 wherein at least the exterior surface of the first platform is made from a material facilitating a comfort to the user's hands and arms, particularly when the elastic member is in a non-constraining relationship and wherein p1 at least the exterior surface of the second platform is made from a material facilitating a comfort to the user's knees, particularly when the elastic member is in a non-constraining relationship.

13. In a combination as set forth in claim 11 wherein the first platform is provided with top and bottom surfaces and wherein rollers are disposed on the bottom surface of the first platform to provide for a movement of the first platform relative to the second platform.

14. In a combination as set forth in claim 11 wherein each of the first and second platforms is provided with top and bottom surfaces and wherein rollers are disposed on the bottom surfaces of the first and second platforms to facilitate a movement between the first and second platforms.

15. In a combination as set forth in claim 11 wherein the first platform is positioned relative to the second platform in the non-constraining relationship to provide for a disposition of the user's hands on the first platform and wherein the second platform is positioned relative to the first member in the non-constraining relationship to provide for a disposition of the user's knees on the second platform.

16. In a combination as set forth in claim 11 wherein the first platform is provided with top and bottom surfaces and wherein rollers are disposed on the bottom surface of the first platform to provide for a movement of the first platform relative to the second platform and wherein the first platform is positioned relative to the second platform in the non-constraining relationship to provide for a disposition of the user's hands on the first platform and wherein the second platform is positioned relative to the first platform in the non-constraining relationship to provide for a disposition of the user's knees on the second platform.

17. In a combination as set forth in claim 12 wherein each of the first and second platforms is provided with top and bottom surfaces and wherein rollers are disposed on the bottom surfaces of the first and second platforms to facilitate a movement between the first and second platforms and wherein the first platform is positioned relative to the second platform in the non-constraining relationship to provide for a disposition of the user's hands on the first platform and wherein the second platform is positioned relative to the first platform in the non-constraining relationship to provide for a disposition of the user's knees on the second platform.

18. In combination in exercise apparatus for a user, including, a first member made from a material providing a knee support for the user, a second member made from a material providing an arm support for the user, movable elements on at least one of the first and second members to provide for a movement of one of the members relative to the other member, an elastic coupling extending between the first and second members to provide for a controlled movement of the one member relative to the other member in accordance with the forces imposed upon the members by the user, and a retaining member extending from the first member in a direction away from the first and second members and constructed to retain the user's feet at a position below the user's knees during the movements of the first and second members relative to each other.

19. In a combination as set forth in claim 18 wherein the one member is movable relative to the other member in a direction substantially corresponding to a line between the first and second members and wherein the elastic coupling is constrainable in accordance with the controlled movements of the one member relative to the other member in the direction substantially corresponding to the line between the first and second members.

20. In a combination as set forth in claim 18 wherein movable elements are disposed on the bottom surface of the one member and are constructed for movement on a support surface to provide for the controlled movement of the one member relative to the other member on the support surface in accordance with the forces imposed upon the one member by the user.

21. In a combination as set forth in claim 18 wherein the elastic coupling constitutes an elastic cord attached at opposite ends to the first and second members.

22. In a combination as set forth in claim 18 wherein the first member has top and bottom surfaces and wherein the top surface of the first member is pliant to receive the user's arms and to provide comfort to the user when the first member receives the user's arms and wherein the second member has top and bottom surfaces and wherein the top surface of the second member is pliant to receive the user's knees and to provide comfort to the user when the second member receives the user's knees.

23. In a combination as set forth in claim 18 wherein the one member is the second member and the other member is the first member and wherein the retaining member includes a detent extending from the first member for receiving and holding the user's feet during the movement of the one member relative to the other member in directions toward and away from the second member.

24. In a combination as set forth in claim 23 wherein the detent has a looped configuration to receive and retain the user's feet within the loop at a position below the user's knees.

25. In a combination as set forth in claim 22 wherein the one member is the first member and the other member is the second member and wherein the retaining member includes a detent extending from the first member for receiving and holding the calves on the user's feet during the movement of the first member relative to the second member in directions toward and away from the second member.

26. In a combination as set forth in claim 22 wherein the one member is the first member and the other member is the second member and wherein the retaining member includes a detent extending from the first member for receiving and holding the ankles on the user's feet during the movement of the first member relative to the second member in directions toward and away from the second member.

27. In a combination as set forth in claim 18 wherein the retaining member includes a detent on the first member for fixedly retaining the user's feet during a movement of the first and second members relative to each other and wherein the first member is provided with pliant properties to support the user's feet during a movement of the first and second members relative to each other and wherein the second member is provided with pliant properties to support the user's arms during a movement of the first and second members relative to each other.

28. In a combination as set forth in claim 18 wherein the elastic coupling is provided with characteristics of thickness and density to provide for the imposition of a particular force by the user for producing a relative movement between the one member and the other member.

29. In a combination as set forth in claim 18 wherein the one member is movable relative to the other member in a direction substantially corresponding to a line between the first and second members and wherein the elastic coupling is constrainable in accordance with the controlled movements of the one member relative to the other member in the direction substantially corresponding to the line between the first and second members and wherein movable elements are disposed on the bottom surface of the one member and are constructed for movement on a support surface to provide for a controlled movement of the one member relative to the other member on the support surface in accordance with the forces imposed upon the one member by the elastic coupling and wherein the elastic coupling constitutes an elastic cord attached at opposite ends to the first and second members and wherein the first member has top and bottom surfaces and wherein the top surface of the first member is pliant to receive the user's knees and to provide comfort to the user when it receives the user's knees and wherein the second member has top and bottom surfaces and wherein the top surface of the second member is pliant to receive the user's arms and to provide comfort to the user when it receives the user's arms.

30. In a combination as set forth in claim 18 wherein the retaining member includes a detent on the first member for fixedly retaining the user's feet during a movement of the first and second members relative to each other and wherein the first member is provided with pliant properties to support the user's knees during a movement of the first and second members relative to each other and wherein the second member is provided with pliant properties to support the user's arms during a movement of the first and second members relative to each other and wherein the elastic coupling constitutes a cord which is provided with characteristics of thickness and density to provide for the imposition of a particular force by the user to produce a relative movement between the one member and the other member.

31. In combination in exercise apparatus for a user, a first member having at least a surface made from a material providing a knee support for the user, a second member having at least a surface made from a material providing a support for an individual one of the arms of the user, a third member having at least a surface made from a material providing a support for the other one of the arms of the user, and a first elastic cord extending from the first member to an individual one of the second and third members, a second elastic cord extending from the first member to the other one of the second and third members, the elastic cords providing for individual movements of each of the second and third members relative to the first member, and a fourth member extending from the first member for retaining the user's feet at a position below the user's knees.

32. In a combination as set forth in claim 31 wherein each of the second and third members is movable independently of the other one of the first and second members in any direction relative to the first member.

33. In a combination as set forth in claim 31 wherein each of the second and third members has top and bottom surfaces and wherein rollers are disposed on the bottom surfaces of each of the second and third members for providing for a movement of the member in any desired direction relative to the first member and independently of the movement of the other one of the first and second members.

34. In a combination as set forth in claim 31 wherein each of the second and third members has top and bottom surfaces and wherein the top surface of each of the second and third members is pliant to receive an individual one of the user's arms and wherein a first plurality of rollers is attached to the bottom of the second member at spaced positions on the second member to provide for a movement of the second member in any direction relative to the first member and wherein a second plurality of rollers is attached to the bottom of the third member at spaced positions on the third member to provide for a movement of the third member in any direction relative to the first member.

35. In a combination as set forth in claim 31 wherein handle structures are provided each disposed on an individual one of the second and third members for grasping by the user to provide for a movement by the user of the individual one of the second and third members in any desired direction.

36. In combination in exercise apparatus for a user, a first member having at least a surface made from a material providing a knee support for the user, second and third members each having at least a surface made from a material providing a support for an individual one of the arms of the user, and first and second elastic cords each extending from the first member to an individual one of the second and third members, the elastic cords providing for individual movements of each of the second and third members relative to the first member and wherein the first member includes a rod adjustable in length and having first and second opposite ends and includes a first support extending from the rod at an intermediate position along the adjustable length of the rod for retaining the knees of the user in a fixed relationship and wherein the first and second elastic cords extend from the rod near the first opposite end of the rod and wherein a second support extends from the rod near the second opposite end of the rod for fixedly retaining the user's feet during the movement of the second and third members relative to the first member.

37. In a combination as set forth in claim 36 wherein an upright included in the second support extends from the rod at a position near the second opposite end of the rod and in a direction transverse to the direction of the rod and wherein a detent included in the second support extends from the upright at an adjustable position on the upright for retaining the user's feet during the movement of individual ones of the second and third members relative to the first member.

38. In a combination as set forth in claim 36 wherein the first support includes a plurality of pliant pads spaced from one another in a direction transverse to the rod to receive each of the user's knees between adjacent pairs of pads.

39. In combination in exercise apparatus for a user, a first member having at least a surface made from a material providing a knee support for the user, second and third members each having at least a surface made from a material providing a support for an individual one of the arms of the user, and first and second elastic cords each extending from the first member to an individual one of the second and third members, the elastic cords providing for individual movements of each of the second and third members relative to the first member and wherein each of the second and third members is movable in any direction relative to the first member and wherein each of the second and third members has top and bottom surfaces and wherein rollers are disposed on the bottom surface of each of the second and third members to provide for a movement of the member in any desired direction relative to the first member and wherein the first member includes a rod adjustable in length and having first and second opposite ends and includes a first support extending from the rod at an intermediate position along the adjustable length of the rods for retaining the knees of the user and wherein the first and second elastic cords extend from a position near the first end of the rod and wherein a second support extends from a position near the second end of the rod for retaining the user's feet during the movement of the second and third members relative to the first member.

40. In combination in exercise apparatus for a user, a first member having at least a surface made from a material providing a knee support for the user, second and third members each having at least a surface made from a material providing a support for an individual one of the arms of the user, and first and second elastic cords each extending from the first member to an individual one of the second and third members, the elastic cords providing for individual movements of each of the second and third members relative to the first member and wherein a pair of handle structures are provided each disposed on an individual one of the second and third members for grasping by the user to provide for a movement by the user of the individual one of the second and third members in any desired direction and wherein each of the second and third members is movable in any direction relative to the first member and wherein each of the second and third members has top and bottom surfaces and wherein rollers are disposed on the bottom surfaces of each of the second and third members for providing for a movement of the member in any desired direction relative to the first member and wherein the first member includes a rod adjustable in length and having first and second opposite ends and includes a first support extending from the rod at an intermediate position along the adjustable length of the rod for retaining the knees of the user and wherein the first and second elastic cords extend from a position near the first end of the rod and wherein the retaining member includes a second support extending from the rod near the second end of the rod for retaining the user's feet during the movement of the second and third members relative to the first member.

41. In combination in exercise equipment for a user, a plurality of members for the user's arms and knees, each of the members being provided with top and bottom surfaces, rollers on the bottom surfaces of at least a particular one of the members for providing for a movement of the particular one of the members relative to another one of the members in the plurality, at least one elastic cord extending between the at least particular one of the members and the other one of the members to provide for a movement of the particular one of the members relative to the other one of the members in accordance with forces imposed by the user on the particular one of the members, and a retaining member operatively coupled to the particular one of the members for retaining the user's feet at a position below the user's knees during the movement of the particular one of the members relative to the other one of the members.

42. In a combination as set forth in claim 41 wherein pliant material is provided on at least the top surfaces of the members to provide for a comfortable disposition of limbs of the user on the members.

43. In a combination as set forth in claim 41 wherein the retaining member includes a detent disposed on at least the particular one of the members to retain a limb of the user in fixed position relative to the at least particular one of the members.

44. In a combination as set forth in claim 41 wherein the particular one of the members is constructed to retain the user's legs in a fixed position on the member.

45. In a combination as set forth in claim 41 wherein the elastic cord is provided with properties to provide for a controlled movement of the particular one of the members by the user relative to the other one of the members between a crouching position of the user and a prone position of the user.

46. In a combination as set forth in claim 42 wherein the retaining member includes a detent disposed on at least the particular one of the members to retain a limb of the user on the at least particular one of the members and wherein the elastic cord is provided with properties to provide for a controlled movement of the particular one of the members by the user relative to the other one of the members between a crouching position of the user and a prone position of the user.

47. In combination in exercise apparatus for a user, a rod, a first support disposed at a first position on the rod for receiving the user's knees, a second support disposed at a second position on the rod for retaining the portion of the user's feet between the knees and the ankles, and first and second elastic cords extending from the rod for providing for alternate positions of the user's body in accordance with the disposition of the elastic cords in constraining and non-constraining relationships as a result of forces imposed upon the cords by the user and the release of these forces by the user.

48. In a combination as set forth in claim 47 wherein the rod is adjustable in length between the first and second supports in accordance with the length of the user's feet between the user's knees and the user's ankles.

49. In a combination as set forth in claim 47 wherein an upright is attached to the rod at the position of the second support and is adjustable in height in accordance with the characteristics of the user's feet.

50. In a combination as set forth in claim 47 wherein the elastic cords extend at first ends from the rod and wherein the first and second elastic cords are respectively attached at second ends to first and second platforms movable independently relative to each other and relative to the first and second supports in accordance with the constraining and non-constraining relationships of the elastic cords.

51. In a combination as set forth in claim 47 wherein the elastic cords extend at first ends from the rod and wherein the first and second elastic cords are respectively attached at second ends to handles for gripping of the handles by the user's hands.

52. In a combination as set forth in claim 50 wherein the rod is adjustable in length between the first and second supports in accordance with the length of the user's feet between the user's knees and the user's ankles and wherein an upright is attached to the rod at the position of the second support and is adjustable in height in accordance with the characteristics of the user's feet.

53. In a combination as set forth in claim 51 wherein the rod is adjustable in length between the first and second supports in accordance with the length of the user's feet between the user's knees and the user's ankles and wherein an upright is attached to the rod at the position of the second support and is adjustable in height in accordance with the characteristics of the user's feet.

54. In a combination as set forth in claim 47 wherein the first support includes a crossbar attached to the rod and extending in a direction transverse to the rod and wherein support members are attached to the crossbar to support the user's knees and wherein the second support includes an upright extending upwardly from the rod and wherein pads are attached to the upright to position the user's feet or to support the user's rear end in the sitting position of the user.

55. In a combination as set forth in claim 54 wherein the rod is adjustable in length between the first and second supports in accordance with the length of the user's feet between the user's knees and ankles and wherein an upright is attached to the rod at the position of the second support and is adjustable in height in accordance with the characteristics of the user's feet.

56. In combination in exercise equipment for a user, a retaining member, an elastic cord having opposite ends removably attached to the retaining member at spaced positions on the retaining member to retain the user's pelvis with the user's back prone on a support surface, and supports on the retaining member for the user's feet when the user's back is prone on the support surface.

57. In a combination as set forth in claim 56 wherein the supports are constructed to retain the user's feet in a particular relationship when the user is prone on the support surface.

58. In a combination as set forth in claim 57 wherein the retaining member is extensible in the vertical direction in accordance with the dimensions of the user.

59. In a combination as set forth in claim 56 wherein the retaining member is extensible in the vertical direction in accordance with the dimensions of the user.

60. In combination in exercise equipment for a user, a first unit for supporting the user's knees, a second unit for supporting the user's arms, the units being constructed to be disposed on a support surface and to provide for a movement of the units relative to each other on the support surface in accordance with forces applied by individual ones of the user's knees on the first unit and the user's arms on the second unit, and a third unit extending from the first unit for retaining the user's feet at positions below the user's knees.

61. In a combination as set forth in claim 60, rollers disposed on at least one of the first and second units to provide for a movement of the at least one of the units relative to the other one of the units in accordance with forces applied by the user on the at least one of the first and second units.

62. In a combination as set forth in claim 60 wherein the third unit includes a detent extending from the first unit for retaining the user's feet on the first unit during the movement of the first and second units relative to each other.

63. In a combination as set forth in claim 62 wherein at least the top surfaces of the first and second units are made from a pliant material.

64. In combination in exercise apparatus for a user, a first member having at least a surface made from a material providing a knee support for the user, second and third members each having a first surface made from a material providing a support for an individual one of the arms of the user, and each of the first, second and third members having a second surface opposite the first surface, rollers disposed on the second surface of at least one of the first member on the one hand and the second and third members on the other hand for providing a movement of individual ones of the user's arms relative to the user's feet, first and second elastic members respectively extending from the first member to individual ones of the second and third members, and a coupling member removably coupled between the second and third members and operative, when coupled to the second and third members, to provide for a unitary movement of the second and third members relative to the first member and operative, when decoupled from at least one of the second and third members, for providing for individual movements of the second and third members relative to the first and second members.

65. In a combination as set forth in claim 64 wherein a retaining member extends from the first member for retaining the user's feet at a position between the user's knees and the user's ankles during the movement of the first member relative to at least one of the second and third members.

66. In combination in exercise apparatus for a user, a first member having at least a surface made from a material providing a knee support for the user, second and third members each having a first surface made from a material providing a support for an individual one of the arms of the user, and each of the first, second and third members having a second surface opposite the first surface, and rollers disposed on the second surface of at least one of the first member on the one hand and the second and third members on the other hand for providing a movement of individual ones of the user's arms relative to the user's feet and wherein the first member is disposed on a rod and wherein a support is disposed on the rod for retaining the feet of the user.

67. In a combination as set forth in claim 66 wherein the rod is adjustable in length to adjust the distance between the first member and the support in accordance with the length of the user's feet between the user's knees and the user's ankles.

68. In a combination as set forth in claim 67 wherein the support constitutes a first support and wherein a second support extends from the rod at a position near the user's ankles and wherein the second support is adjustable in accordance with the length of the user's feet between the user's knees and the user's ankles.

69. In combination in exercise apparatus for a user, a first member having at least a surface made from a material providing a knee support for the user, second and third members each having a first surface made from a material providing a support for an individual one of the arms of the user, and each of the first, second and third members having a second surface opposite the first surface, and rollers disposed on the second surface of at least one of the first member on the one hand and the second and third members on the other hand for providing a movement of individual ones of the user's arms relative to the user's feet and wherein a rod adjustable in length is provided and wherein the first member is disposed on the rod and includes a first support extending from the rod for retaining the knees of the user and wherein a second support extends from the rod near the end of the rod for retaining the user's feet during the movement of at least one of the second and third members relative to the first member.

70. In a combination as set forth in claim 69 wherein an upright included in the second support extends from the rod near the one end of the rod in a direction transverse to the direction of the rod and wherein a detent included in the second support extends from the upright at an adjustable position on the upright for retaining the user's feet during the movement of individual ones of the second and third members relative to the first member.

71. In combination in exercise apparatus for a user, a rod, first members supported by the rod for supporting the knees of the user, second members supported by the rod at a position displaced rearwardly from the user for supporting the buttocks of the user in a seated position of the user, and an elastic cord attached to the rod at an intermediate position along the length of the rod at a position forwardly of the first members and having free ends for manipulation by the hands of the user.

72. In a combination as set forth in claim 71, handles attached to the free ends of the cords to facilitate the grasping of the cords by the hands of the user.

73. In a combination as set forth in claim 71 wherein the rod is provided with a variable length dependent upon the dimensions of the user.

74. In a combination as set forth in claim 71 wherein the first members are adjustable in accordance with the dimensions of the user and are constructed to position and support the user's knees.

75. In a combination as set forth in claim 71 wherein the second members are adjustable in height in accordance with the dimensions of the user.

76. In a combination as set forth in claim 72 wherein the rod is provided with a variable length dependent upon the dimensions of the user and wherein the first members are adjustable in accordance with the dimensions of the user and are constructed to position and support the user's knees and wherein the second members are adjustable in height in accordance with the dimensions of the user.

77. In a combination in exercise apparatus for a user, a first member for supporting the knees of the user, second and third members for supporting individual ones of the arms of the user, a pair of elastic members each coupling the first member to an individual one of the second and third members, and a member removably coupling the second and third members and operative in a coupled relationship to the second and third members for providing for a coordinated movement of the second and third members along a support surface relative to the first member and operative in an uncoupled relationship to the second and third members for providing for individual movements of each of the second and third members relative to the first member along the support surface.

78. In a combination as set forth in claim 77 wherein the coupling member is non-elastic to provide for a rigid relationship between the second and third members when the coupling member is coupled to the second and third members.

79. In a combination as set forth in claim 77 wherein a fourth member is coupled to the first member for retaining the feet of the user at a position below the knees of the user when the first member is moved relative to individual ones of the second and third members.

80. In a combination as set forth in claim 79 wherein a rod is disposed between the first and fourth members to maintain the first and fourth members in a relationship for disposing the user's knees on the first member and for retaining the user's feet in a spaced relationship to the first member at positions below the knees of the user.

81. In a combination as set forth in claim 80 wherein the rod is adjustable in length in accordance with the dimensions of the user and wherein a support extends from the rod to retain the user's feet in a fixed relationship to the rod at positions below the knees of the user.

82. In a combination as set forth in claim 78 wherein a fourth member is coupled to the first member for retaining the feet of the user at a position below the knees of the user when the first member is moved relative to individual ones of the second and third members and wherein a rod is disposed between the first and fourth members to maintain the first and fourth members in a relationship for disposing the user's knees on the first member and for retaining the user's feet in a spaced relationship to the first member at positions below the knees of the user and wherein the rod is adjustable in length in accordance with the dimensions of the user and wherein a support extends from the rod to retain the user's feet in a fixed relationship to the rod at positions below the knees of the user.

* * * * *